US006927372B2

(12) United States Patent
Ekinge et al.

(10) Patent No.: US 6,927,372 B2
(45) Date of Patent: Aug. 9, 2005

(54) MICROWAVE OVEN WITH CONVECTION HEATING

(75) Inventors: Roland Ekinge, Norrkoping (SE); Gunnar Nyren, Norrkoping (SE); Ricardo Garcia-Padron, Linkoping (SE)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 10/924,134

(22) Filed: Aug. 23, 2004

(65) Prior Publication Data

US 2005/0051540 A1 Mar. 10, 2005

(30) Foreign Application Priority Data

Sep. 8, 2003 (SE) ..... 0302407

(51) Int. Cl.[7] ..... H05B 6/80

(52) U.S. Cl. ..... 219/681; 219/757; 219/738; 219/400; 126/21 A

(58) Field of Search ..... 219/681, 685, 219/757, 738, 400; 126/21 A

(56) References Cited

U.S. PATENT DOCUMENTS

| | | | | | |
|---|---|---|---|---|---|
| 4,337,384 | A | * | 6/1982 | Tanaka et al. | 219/681 |
| 5,468,935 | A | * | 11/1995 | Wang | 219/400 |
| 5,958,274 | A | * | 9/1999 | Dobie et al. | 219/681 |
| 6,259,064 | B1 | * | 7/2001 | Wilson | 219/400 |
| 6,376,817 | B1 | * | 4/2002 | McFadden et al. | 219/681 |

* cited by examiner

*Primary Examiner*—Philip H. Leung
(74) *Attorney, Agent, or Firm*—John F. Colligan; Stephen Krefman; Robert O. Rice

(57) ABSTRACT

A combined microwave and hot-air circulating cooking appliance is disclosed. The appliance has a plurality of air injection openings that are provided in a wall of the cooking cavity for injecting heated air into the same. Each of the injection openings is connected to a heating compartment an air conduit having such dimensions so as to prevent propagation of microwave energy through the conduit.

8 Claims, 3 Drawing Sheets

MICROWAVE OVEN WITH CONVECTION HEATING

BACKGROUND OF THE INVENTION

1. Field of the Invention

The present invention relates to microwave ovens with a capability of convection heating by circulation of hot air within the microwave cavity.

2. Description of the Related Art

Cooking appliances arranged for both microwave heating and convection heating by hot-air circulation are known. Such appliances can generally operate in microwave mode, where microwave heating is effected, or in convection mode, where heating by hot-air circulation is effected. It is also possible to use a combination of the two modes, in which microwaves assist the hot-air heating process.

In a fan-assisted convection heating oven, it is generally desired to have a uniform distribution of hot air within the cooking chamber in order to promote even heating of foodstuff placed therein. Typically, a heater and a fan are placed behind the rear wall of the microwave cooking cavity in a dedicated compartment. Air is drawn by the fan from the cooking cavity into the compartment through perforations in the rear wall. The fan is placed directly behind the perforations. The air sucked in from the cooking cavity is then blown radially out from the fan and passes the heater to reach an elevated temperature, and is thereupon reintroduced into the cooking cavity through additional perforations at the outer edges of the rear cavity wall. In this way, air is cycled through the cavity and the dedicated heater compartment to provide convection heating for the foodstuff placed in the oven.

The perforations in the rear wall of the cavity are typically sufficiently small in order to prevent leakage of microwave energy from the microwave cooking cavity.

However, these perforations have the potential to cause an obstacle for the circulating air, leading to a lower flow of air than what is desired. To overcome this, the air flow (fan speed) or the air temperature must be increased, which unfortunately may lead to over-heating or drying of foodstuffs or portions thereof in the vicinity of the inlet perforations.

The inventors of the present invention have also identified additional problems with the prior art. In the arrangement as described above, it is believed that the hot air injected into the cooking cavity through the perforation at the outer edges of the rear wall may exhibit a whirl. In other words, it appears there is a tangential component in the air flow (i.e. the air does not flow perpendicularly towards the front of the cavity) which may cause regions of different temperature in the cavity. This whirl is a residue of the fan action that is communicated into the cooking cavity through the perforations. As a result, due to the whirl, the hot air might not reach all parts of the cooking cavity, which could result in uneven heating. Accordingly, there is a need for a cooking appliance which improves or helps overcome the known drawbacks associated with the prior art.

SUMMARY OF THE INVENTION

The present invention attempts to improve flow of heated air into a cooking cavity of an appliance by providing the appliance with comparatively large openings in the rear wall of the cavity, and to have air conduits connected to these openings. It is believed that these air conduits have three primary functions, namely to prevent microwave energy from escaping out of the cooking cavity, to guide hot air in a desired manner, and to reduce the whirl of the air injected into the cooking cavity.

In an exemplary embodiment, the conduits have a cross-sectional area substantially corresponding to the area of the openings, and which is large compared to each of the central perforations but sufficiently small to prevent propagation of microwaves in the air conduits. However, as will be described in more detail below, the cross-sectional area of the conduits, as well as their mounting angle with respect to the central fan, are design matters that can be decided according to the desired action.

When air is forced by the action of the fan through the conduits, the whirl in the air stream caused by the fan is reduced, such that the air enters the cooking cavity substantially without any tangential flow component.

In another embodiment of the invention, at least four inlet openings are formed in the rear wall of the cooking cavity, each connected to a respective air conduit. The inlet openings are arranged adjacent each corner of the rear wall (one in each quadrant of the wall). The target is to create a balance between the airflow from the four openings to achieve an even or otherwise desired heating of foodstuff placed in the cooking cavity. The heating balance is achieved by adjusting one or more of the air speed, air direction and volume flow from each inlet opening (through each air conduit). Further, the air speed, air direction and volume flow might be adjusted by the mounting angle of each conduit with respect to the rotation center of the fan, and the height and width of each conduit. Generally, each air injection opening in the rear wall (output from each conduit into the cooking cavity) should have a diameter equal to, or smaller than, the width of the respective air conduit. It is often desired to have the air volume flow from the upper injection openings reduced compared to that from the lower openings.

In an exemplary embodiment, the air injection openings have a diameter of about 10 mm or more, and preferably about 20 mm or more. In one unlimiting example, if the openings have a diameter of about 25 mm and are connected to a conduit having equal inner height and width of about 25 mm, a conduit length of at least about 30 mm is preferred, more preferably about 60 mm.

BRIEF DESCRIPTION OF THE DRAWINGS

In the detailed description below, reference is made to the accompanying drawings, in which.

In the drawings, similar reference numerals designate similar features throughout.

DETAILED DESCRIPTION

Figure 1:
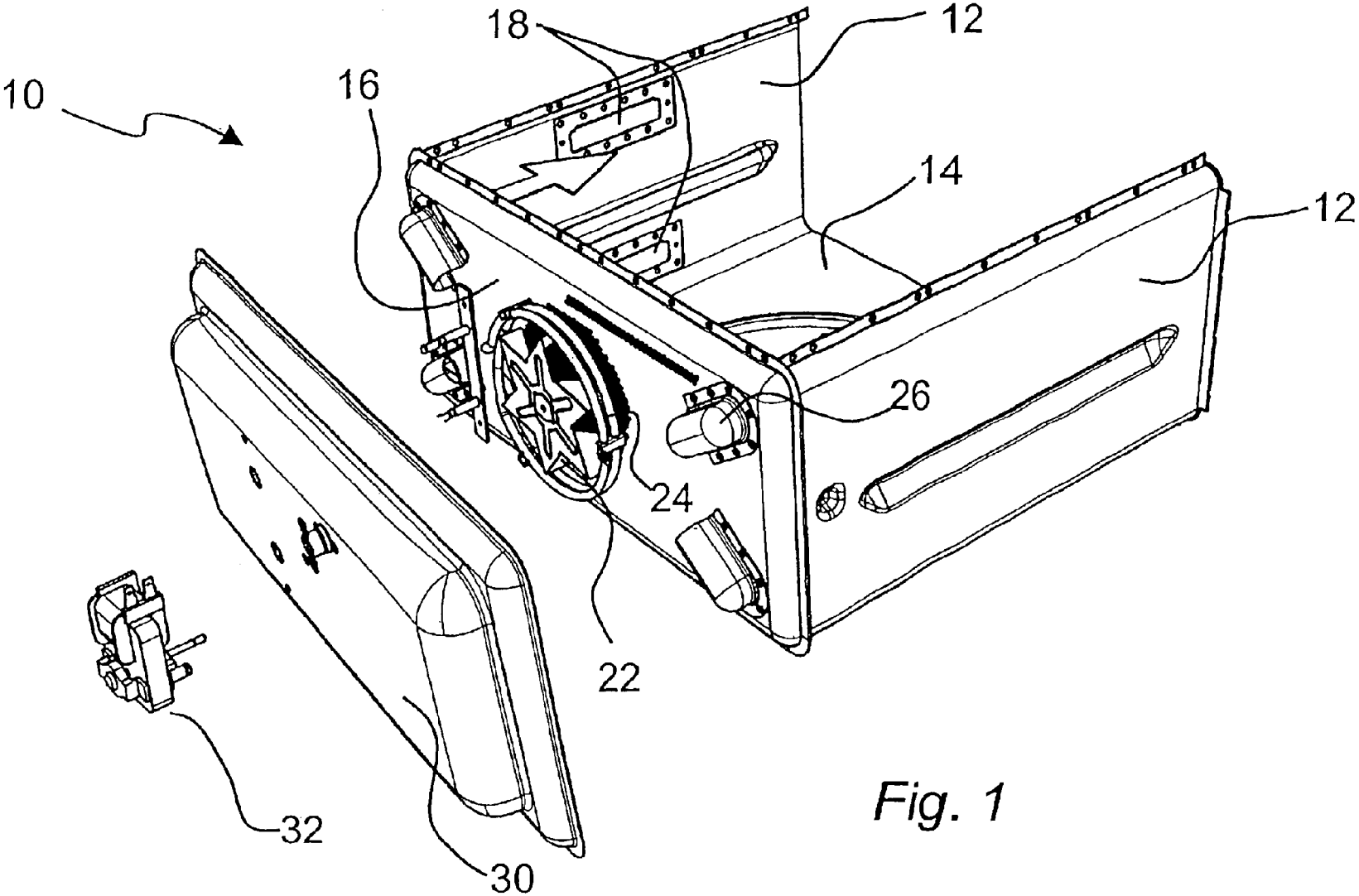
FIG. 1 is an exploded perspective view of the interior of a cooking appliance according to the invention seen from the back.
Figure 2:
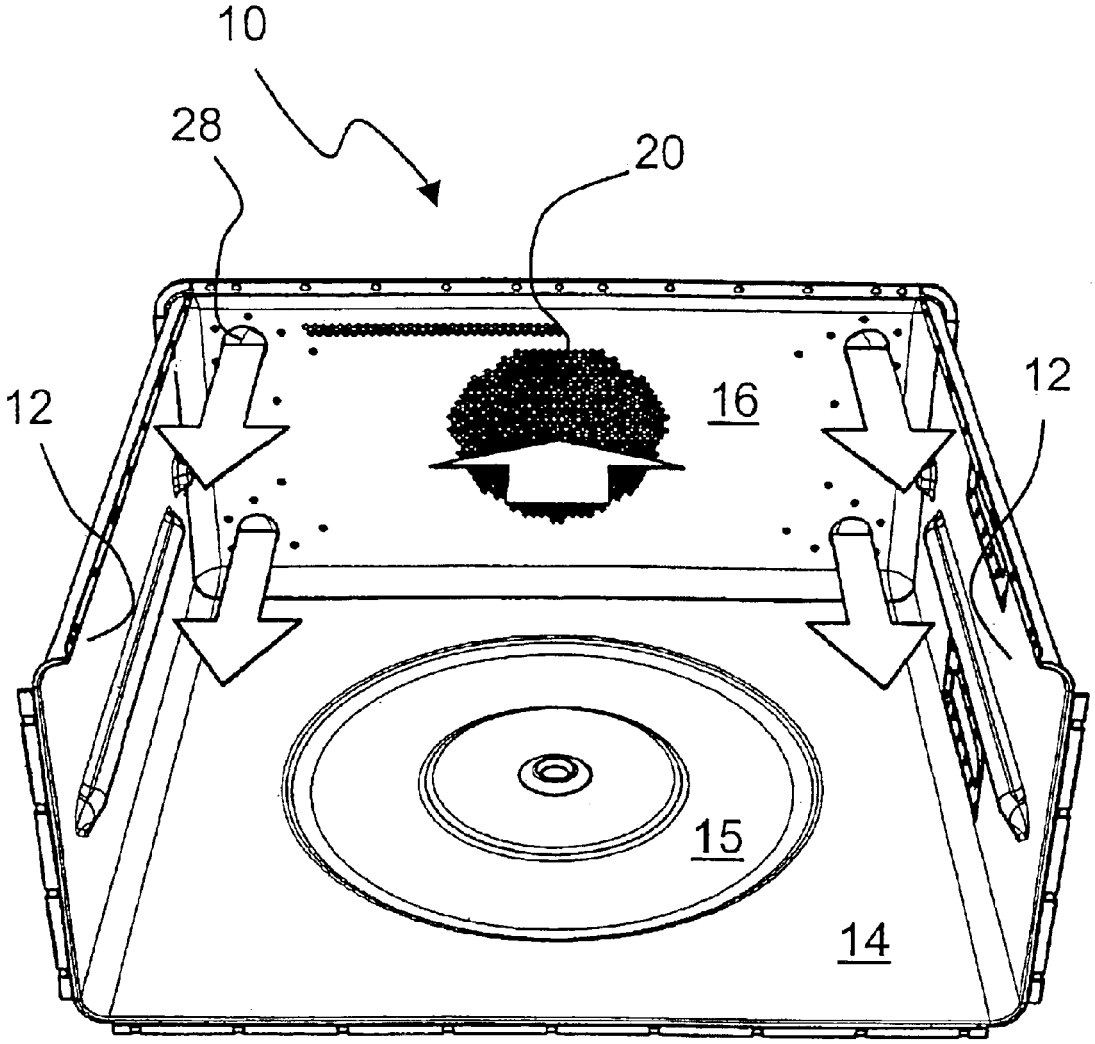
FIG. 2 is a perspective view of the cooking appliance of FIG. 1 seen from the front.

FIGS. 1 and 2 show a perspective view of a portion of a combined microwave and hot-air circulating cooking appliance 10 according to the present invention from the back and from the front, respectively. The figures show the interior of the appliance with the outer casing taken away. For clarity, the ceiling (top wall) of the cooking cavity, as well as the front door have been removed. As a result, the side walls 12, bottom wall 14 and rear wall 16 of a cooking cavity 30 are shown. Typically, the cooking cavity 30 comprises inlet ports 18 for feeding microwave energy into the cavity and the bottom 14 of the cavity has a recess 15 for receiving a turntable or the like, but the invention is not intended to be limited by these elements.

In this nonlimiting embodiment, behind a perforated region 20 of the rear wall 16 of the cavity, there is provided a fan 22 surrounded by a heating coil 24. Near each corner of the rear wall 16, there is located an air conduit 26 which is connected to an opening 28 into the cooking cavity of the appliance 10. A lid 30 is attached to the back side of the rear wall 16 for defining a dedicated air heating compartment. In addition, a motor 32 for driving the fan 22 is located behind this compartment.

In operation, the fan 22 is rotated in such a sense that is sucks air from the cooking cavity through the perforated central region 20 and into the heating compartment. This air is then forced more or less radially away from the fan 22 and passed through the heating coil 24. In this way, the air is given an elevated temperature. The heated air then enters the air conduits 26 and is directed through the openings 28 in the rear wall 16 back into the cavity. In this way, heating by hot-air circulation is effected. The direction of the air flow at the rear wall of the cavity is indicated with arrows in FIGS. 1 and 2.

Figure 3:
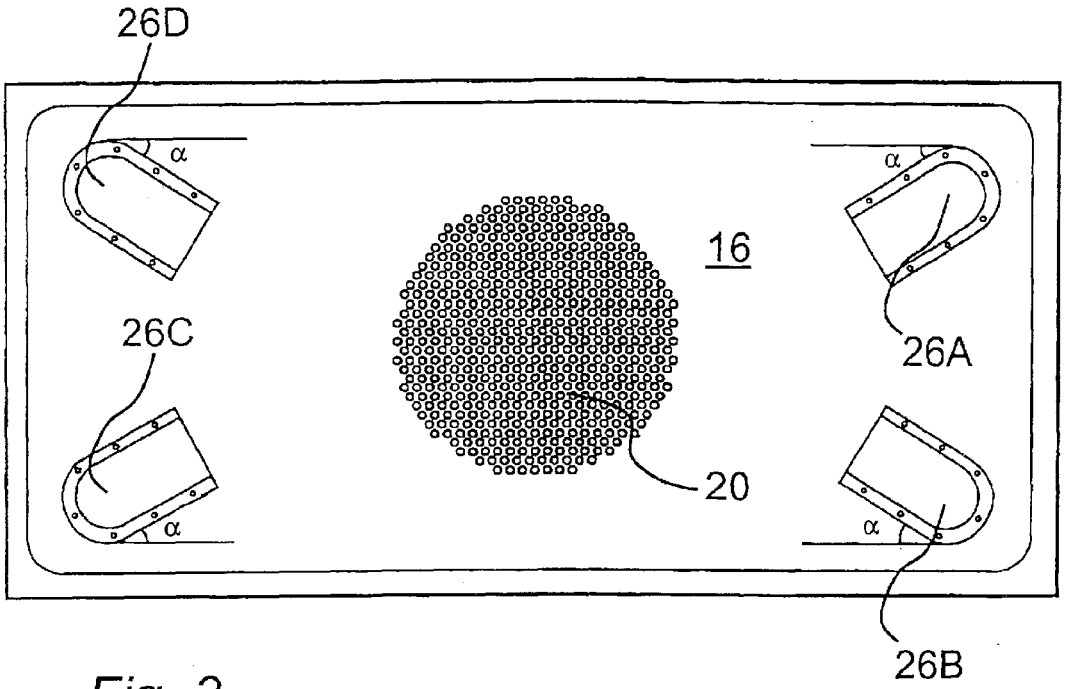
FIG. 3 is a schematic plan view of the back side of the rear wall, showing the air conduits and a central perforated region.

FIG. 3 is a schematic plan view of the back side of the rear wall 16, showing the air conduits 26 and the central perforated region 20.

Depending on oven characteristics—such as type of fan, nature of heating coil, and oven dimensions—a number of different configurations of the air conduits 26 could result in even heating within the cooking cavity. It has been identified that the cross-sectional area of the conduits (width and height) affect the overall performance. In addition, the mounting angle of each conduit with respect to the rotation center of the fan is a contributing factor. The mounting angles of the conduits should be selected to guide the injected air towards the ceiling/wall and the bottom/wall, thereby "rectifying" the tangential part of the air leaving the rotating fan wheel, thereby reducing the whirl in the air flow inside the cooking cavity.

Typically, a larger flow/velocity of air at the bottom of the cavity compared to the top gives an improved heating evenness. For example, an air velocity of about 0.5–2.5 m/s through the upper, and about 2–6 m/s through the lower injection openings has proven effective.

In order to achieve microwave sealing, each conduit 26 should provide sufficient attenuation for the microwave frequency employed. Theoretically, a conduit of circular cross-section with a diameter of just under about 70 mm needs to be infinitely long (situation at cut-off for the conduit). Of course, a smaller diameter would allow a shorter length with maintained microwave sealing. If the diameter would be as small as about 5 mm, a length of only about 1 mm is required.

One practical nonlimiting example in line with the present invention employs conduit members having a rounded upper part (half pipe) that is elongated in height by straight walls. This is shown in detail in FIG. 4. These conduit members are attached to the outside of the cavity wall and connected to the injection openings, such that air conduits are formed. A width (W) of about 25 mm, a height (H) of about 25 mm and a length (L) of about 30 mm gives a cut-off frequency for the conduit of about 5 GHz, and an attenuation of about 65 dB at a microwave frequency of about 2.45 GHz. The conduit members have an open end which is generally directed towards the fan when the conduit members are attached to the back side of the rear cavity wall. Opposite the open end, the conduits are terminated in a dead end, in order for the air flow to be directed through the injection openings in the rear wall. It is to be understood, however, that various other designs for the conduits are conceivable within the scope of the invention as defined in the appended claims.

Figure 4:
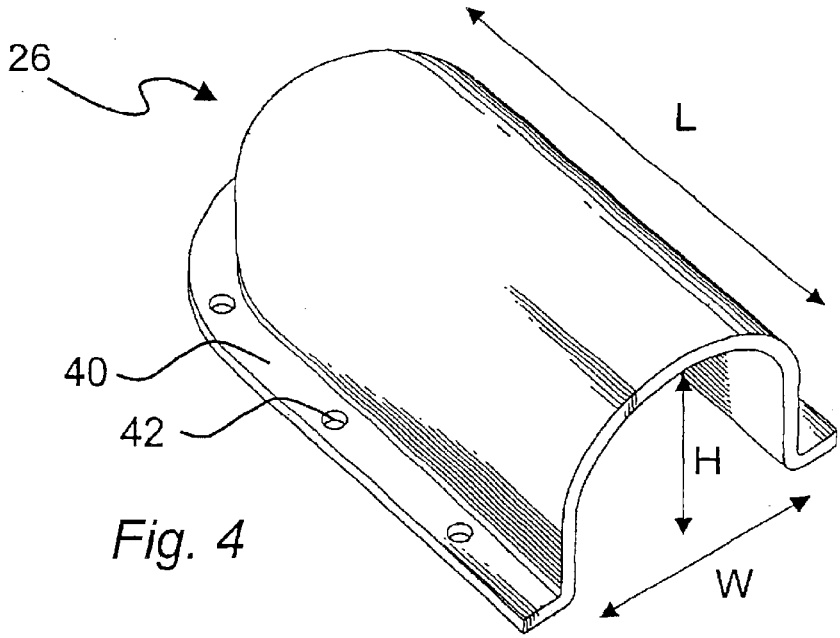
FIG. 4 is a view showing the conduit member in closer detail.

In order for the air conduits 26 to act as microwave chokes, they should be galvanically connected to the rear wall 16 of the cavity. Each conduit member as shown in FIG. 4 may, for example, be attached to the back of the rear wall by rivets or the like. Suitably, the conduit members have a flange 40 with holes 42 for easy attachment to the cavity wall.

The air injection openings 28 in the rear wall of the cavity should have a diameter equal to, or smaller than, the width of the conduit 26 connected thereto. In the preferred embodiment, the diameter of the openings 28 is about equal to the width of the conduit 26. Generally, the openings are placed close to or near the corners in a respective quadrant of the rear wall (for the case with four openings). The reason for this is that the air flow towards the front door of the oven should be as undisturbed as possible. However, it is conceivable within the scope of the invention to have more or fewer than four openings, as well as other placements thereof.

Referring now to FIGS. 3 and 4, some additional nonlimiting examples will be given of configurations that could result in even heating within the cooking cavity.

In these examples, there are four air injection openings, each with a respective air conduit. The conduits are labeled 26A–D, where 26A and 26D are the upper conduits. Note that the angle $\alpha$ is the angle between the conduit member and the horizontal direction, as shown in FIG. 3. For a square rear wall, an angle of 45 degrees then means that the conduit is aligned directly towards the rotation center of the centrally placed fan.

EXAMPLE 1

| Conduit | Length, L | Width, W | Height, H | Angle, $\alpha$ |
|---|---|---|---|---|
| 26A | 60 mm | 26 mm | 10 mm | 45° |
| 26B | 60 mm | 26 mm | 26 mm | 45° |
| 26C | 60 mm | 26 mm | 26 mm | 45° |
| 26D | 60 mm | 26 mm | 8 mm | 60° |

In Example 1, the upper conduits A and D have a smaller height than the lower conduits in order to provide a larger airflow at the bottom of the cooking cavity. To some degree, the whirl produced by the fan is reduced when the air flows through the conduits. However, the final reduction of whirl is obtained by mounting conduit D at a larger angle than the other conduits.

EXAMPLE 2

| Conduit | Length, L | Width, W | Height, H | Angle, α |
|---|---|---|---|---|
| 26A | 60 mm | 26 mm | 26 mm | 45° |
| 26B | 60 mm | 26 mm | 26 mm | 45° |
| 26C | 60 mm | 26 mm | 26 mm | 45° |
| 26D | 60 mm | 26 mm | 26 mm | 72° |

In Example 2, all the conduits have about the same dimensions. Hence, only one type of conduit member is required for this embodiment. Still, a desired flow of hot air in the cooking cavity can be obtained. In this example, conduit D is again mounted at a larger angle than the other conduits, in order to provide the final reduction of whirl and obtain the desired heating evenness in the cooking cavity.

In both examples above, the diameter of each of the injection openings is equal to the width of the conduits, i.e. about 26 mm.

Having read and understood this description, the person of ordinary skill in the art will find a number of different configurations for the injection openings and the air conduits that fall within the scope of the present invention.

For example, it will be understood by the skilled person that the injection openings for hot air according to the present invention could be provided in any cavity wall, including the bottom wall and the top wall. It is also understood that the hot air could be injected into the cavity through one wall, and sucked out through another wall.

A combined microwave and hot-air circulating cooking appliance has been disclosed. Flow of hot air within a cooking cavity of the appliance should be improved by having large-diameter injection openings in a wall of the cavity, through which openings hot air is injected into the cooking cavity. In order to prevent leakage of microwave energy from the cavity through these openings, an air conduit is connected to each opening. Each of the air conduits has such dimensions that propagation of microwave energy at the operational microwave frequency of the appliance through the conduit is prevented.

Moreover, the use of air conduits according to the present invention should lead to reduced whirl in the air flow within the cooking cavity thereby promoting a more uniform temperature.

What is claimed is:

1. A cooking appliance, comprising a cooking cavity, a microwave feeding arrangement for feeding microwave energy into the cooking cavity, a heater for elevating the temperature of air circulating in the cooking cavity, and a fan for circulating the air within said cavity, the heater and the fan being arranged in a dedicated air heating compartment outside the cooking cavity, wherein a plurality of air injection openings are provided in a wall of the cavity for injecting heated air into the cooking cavity, each of the injection openings is connected to the heating compartment by an air conduit having such dimensions so as to prevent propagation of microwave energy through the conduit, each of the air conduits is comprised of a conduit member attached to the outside of the wall, and the conduit member has the form of a half pipe.

2. The cooking appliance according to claim 1, comprising an injection opening in the vicinity of each corner of the wall.

3. The cooking appliance according to claim 2, wherein the wall further comprises air suction openings for allowing air to flow from the cooking cavity into the heating compartment.

4. The cooking appliance according to claim 3, wherein the suction openings are comprised of a perforated region centrally in the wall.

5. The cooking appliance according to claim 2, wherein each of the air injection openings has a diameter of at least 10 mm or more, and wherein the air conduit to which each opening is connected has substantially a width equal to or larger than the diameter of the injection opening.

6. The cooking appliance according to claim 5, wherein the length of each of the air conduits is at least 30 mm.

7. The cooking appliance according to claim 2, wherein the air conduits that connect to injection openings in the upper portion of the wall have a smaller cross-sectional area than the air conduits that connect to openings in the lower portion of the wall.

8. The cooking appliance according to claim 2, wherein air conduits are arranged such that the air velocity through the upper openings is in the range of about 0.5–2.5 m/s, and the air velocity through the lower openings is in the range of about 2.0–6.0 m/s.

* * * * *